US007758318B2

(12) United States Patent
Yokota et al.

(10) Patent No.: US 7,758,318 B2
(45) Date of Patent: Jul. 20, 2010

(54) HERMETIC COMPRESSOR

(75) Inventors: Kazuhiro Yokota, Kanagawa (JP); Akihiko Kubota, Kanagawa (JP); Kazuhiko Ohno, Kanagawa (JP)

(73) Assignee: Panasonic Corporation, Osaka (JP)

( * ) Notice: Subject to any disclaimer, the term of this patent is extended or adjusted under 35 U.S.C. 154(b) by 787 days.

(21) Appl. No.: 10/590,471

(22) PCT Filed: Mar. 16, 2006

(86) PCT No.: PCT/JP2006/305751

§ 371 (c)(1),
(2), (4) Date: Aug. 23, 2006

(87) PCT Pub. No.: WO2006/109475

PCT Pub. Date: Oct. 19, 2006

(65) Prior Publication Data

US 2008/0267792 A1 Oct. 30, 2008

(30) Foreign Application Priority Data

Mar. 30, 2005 (JP) ..... 2005-097421

(51) Int. Cl.
*F04B 39/00* (2006.01)

(52) U.S. Cl. ..... 417/312

(58) Field of Classification Search ..... 417/312, 417/902; 181/229, 249, 255, 262, 403
See application file for complete search history.

(56) References Cited

U.S. PATENT DOCUMENTS

| | | | | |
|---|---|---|---|---|
| 5,039,287 | A * | 8/1991 | Da Costa | 418/63 |
| 5,240,391 | A * | 8/1993 | Ramshankar et al. | 417/410.1 |
| 5,288,212 | A * | 2/1994 | Lee | 417/312 |
| 5,496,156 | A | 3/1996 | Harper et al. | |
| 6,691,823 | B2 | 2/2004 | Lee et al. | |
| 2005/0135955 | A1 * | 6/2005 | Iversen et al. | 417/902 |
| 2006/0039808 | A1 | 2/2006 | Kobayashi | |

FOREIGN PATENT DOCUMENTS

| | | | |
|---|---|---|---|
| JP | 03-064680 | A | 3/1991 |
| JP | 06-081769 | | 3/1994 |
| JP | 2000-130328 | | 5/2000 |
| JP | 2002-317767 | A | 10/2002 |
| KR | 2003-0043016 | A | 6/2003 |
| WO | WO2004/099617 | | 11/2004 |

OTHER PUBLICATIONS

International Search Report for application No. PCT/JP2006/305751 dated Aug. 9, 2006.

* cited by examiner

*Primary Examiner*—Devon C Kramer
*Assistant Examiner*—Bryan Lettman
(74) *Attorney, Agent, or Firm*—RatnerPrestia

(57) ABSTRACT

A hermetic compressor has a hermetic container, a suction pipe, a compressing mechanism and a suction muffler. The suction pipe includes a large diameter part opening to an inside of the hermetic container and a small diameter part connected to an external refrigerating system, and the suction pipe is fixed with the hermetic container. The compressing mechanism is accommodated inside the hermetic container. The suction muffler forms a muffling space communicated with the compressing mechanism. The suction muffler is provided with an inlet opening which communicates the muffling space with an inside space of the hermetic container and faces closely an opening of the large diameter part of the suction pipe.

8 Claims, 4 Drawing Sheets

HERMETIC COMPRESSOR

This application is a U.S. National Phase Application of PCT International Application PCT/JP2006/305751.

TECHNICAL FIELD

This invention is related to a hermetic compressor to be used for a refrigerator and the like.

BACKGROUND ART

A hermetic compressor is disclosed in U.S. Pat. No. 5,496,156 for instance, in which an inlet opening of a suction muffler is disposed closely facing a suction pipe for achieving a high efficiency. The conventional hermetic compressor is explained hereinafter with reference to a drawing.

FIG. 4 is a cross-sectional view of the conventional hermetic compressor. Suction pipe 2 which opens into hermetic container 1 is fixed with hermetic container 1. Hermetic container 1 contains compressing mechanism 7 which includes cylinder 4 in which piston 3 reciprocates, and suction muffler 6 forming muffling space 5. Suction muffler 6 is provided with inlet opening 8 communicating muffling space 5 with a space of inside hermetic container 1. Inlet opening 8 is disposed closely facing suction pipe 2.

A motion of thus constituted hermetic compressor is explained next. Piston 3 reciprocates inside cylinder 4, thereby cooling medium flowing from an external refrigerating system (not illustrated) through suction pipe 2 is once released into hermetic container 1. The cooling medium is drawn into suction muffler 6 through inlet opening 8, and then intermittently drawn into cylinder 4 through muffling space 5. At this time, since suction pipe 2 and inlet opening 8 are closely faced each other, the cooling medium is drawn into suction muffler 6 with keeping its relatively low temperature. Consequently, drawn mass of the cooling medium (cooling medium circulating amount) per unit period of time becomes large therefore efficiency is increased, thus efficiency of the hermetic compressor is enhanced.

However, with above-mentioned constitution, when the cooling medium is released through suction pipe 2 into hermetic container 1, the cooling medium is mixed with high temperature cooling medium that already exists in the hermetic container 1. Thereby, the temperature of the cooling medium introduced by inlet opening 8 into cylinder 4 becomes higher than the cooling medium at an opening portion of suction pipe 2. Because of the reason, cooling medium circulating amount is reduced, insufficiently enhancing efficiency of the compressor.

SUMMARY OF THE INVENTION

A hermetic compressor of the present invention has a hermetic container, a suction pipe, a compressing mechanism and a suction muffler. The suction pipe includes a large diameter part which opens into an inside of the hermetic container and a small diameter part connected to an external refrigerating system. The suction pipe is fixed with the hermetic container. The compressing mechanism is accommodated inside the hermetic container. The suction muffler forms a muffling space which is communicated with the compressing mechanism. The suction muffler is provided with an inlet opening which communicates the muffling space with an inside space of the hermetic container and faces closely an opening of the large diameter part of the suction pipe. With this constitution, low temperature cooling medium can be introduced to the compressing mechanism, so that a hermetic compressor having a high refrigerating efficiency is obtained.

DETAILED DESCRIPTION OF PREFERRED EMBODIMENT

Hereinafter, an exemplary embodiment of the present invention is described with reference to drawings. The description of the embodiment does not necessarily limit the invention.

Figure 1:
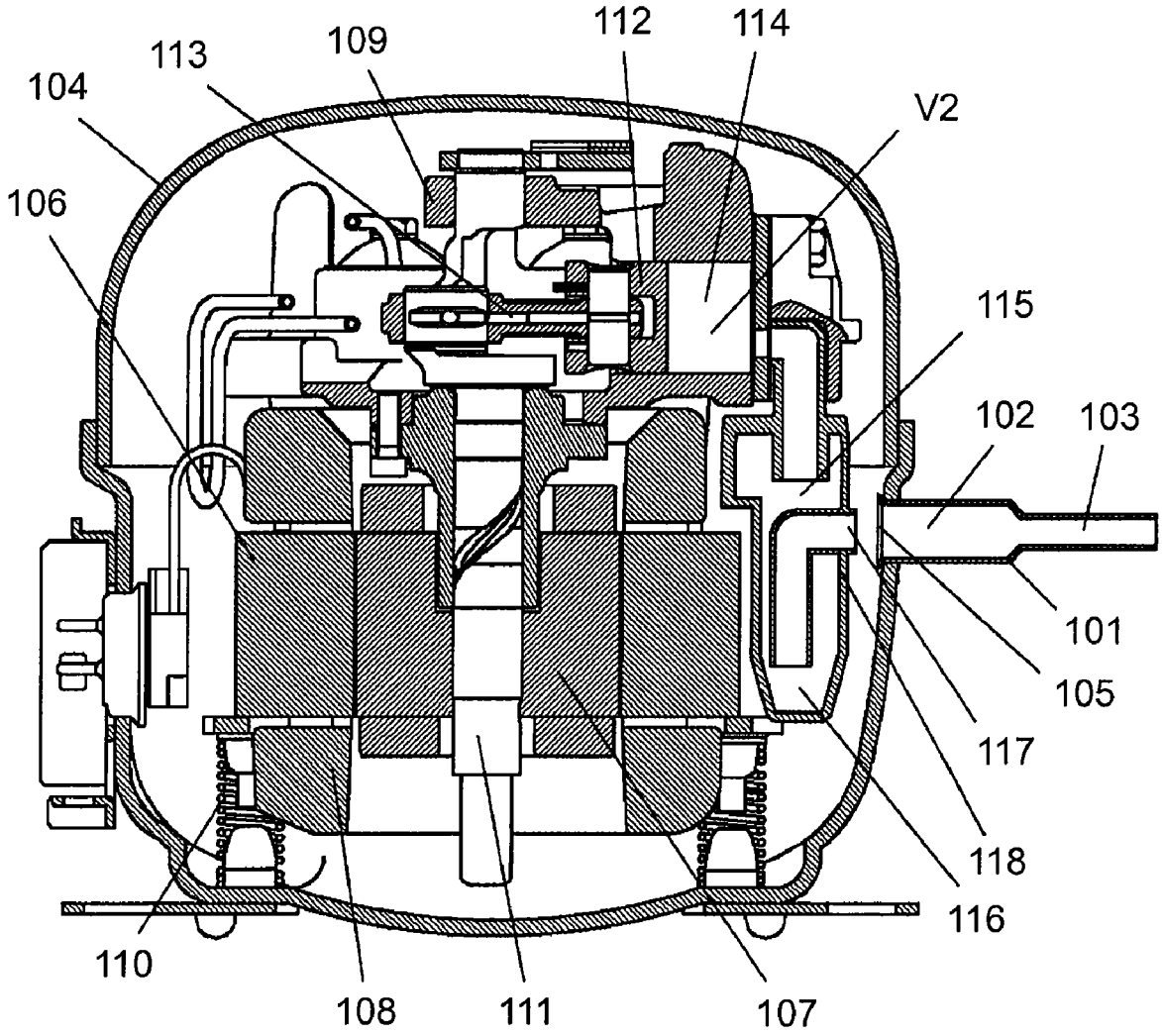
FIG. 1 is a cross-sectional view of a hermetic compressor in accordance with an exemplary embodiment of the present invention.
Figure 2:
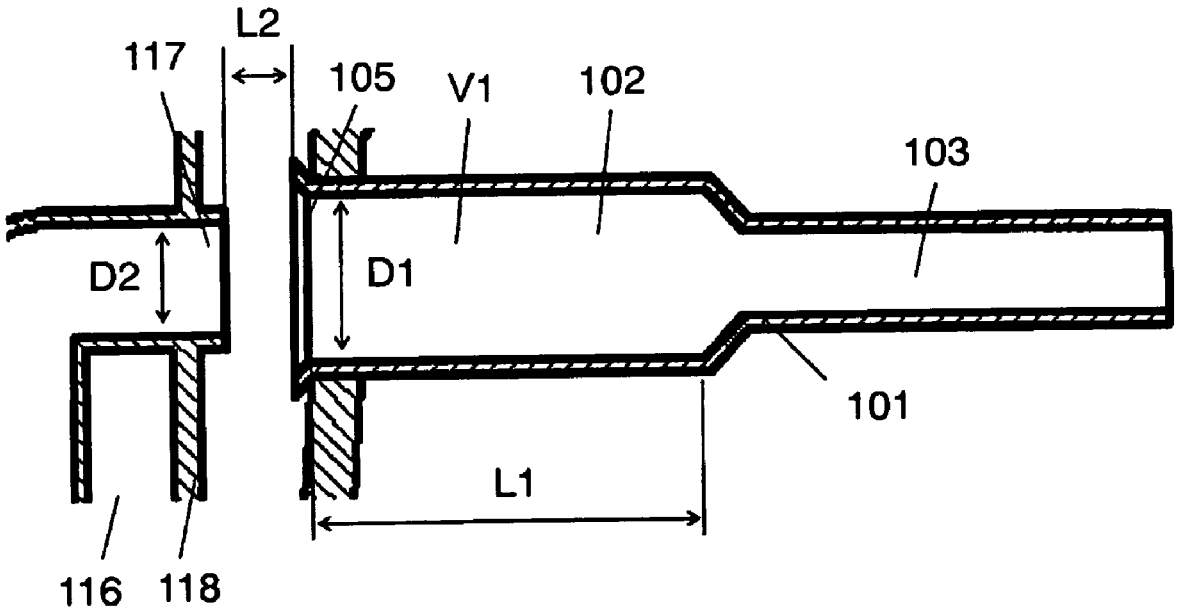
FIG. 2 is an expanded view of a main part of FIG. 1.

FIG. 1 is a cross-sectional view of a hermetic compressor in accordance with the exemplary embodiment of the present invention, and FIG. 2 is an expanded view of a main part of FIG. 1.

Hermetic container 104 contains motor 108 having stator 106 and rotor 107, and compressing mechanism 109 driven by motor 108. Motor 108 and compressing mechanism 109 are flexibly-supported by spring 110 placed inside hermetic container 104. Hermetic container 104 is filled with cooling medium.

Compress mechanism 109 includes shaft 111 fixed with rotor 107, cylinder 114, piston 112 reciprocating inside cylinder 114, and connecting rod 113 connecting shaft 111 with piston 112. Suction muffler 116 forms muffling space 115 that is communicated with cylinder 114. Inlet opening 117 communicates muffling space 115 with a space inside hermetic container 104. Inlet opening 117 is formed on outer surface 118 of suction muffler 116 so that inlet opening 117 closely faces opening 105 of suction pipe 101. As shown in FIG. 2, inlet opening 117 is preferably opened and protruded a little from outer surface 118.

Suction pipe 101 has large diameter part 102 and small diameter part 103. Large diameter part 102 is fixed with hermetic container 104 and is opened to hermetic container 104 at opening 105. Small diameter part 103 is connected to a lower pressure side of an external refrigerating system (not illustrated). Internal diameter D1 at opening 105 is preferably larger than opening diameter D2 of inlet opening 117, and length L1 of large diameter part 102 is preferably longer than internal diameter D1 of large diameter part 102. Length L1 stands for a distance from opening 105 to small diameter part 103.

Volume V1 defined by large diameter part 102 is preferably about 0.5 times as large of effective cylinder volume V2 of compressing mechanism 109. Effective cylinder volume V2 stands for volume of cylinder 114 measured from a bottom dead center to a top dead center of piston 112. Distance L2 between inlet opening 117 and opening 105 is preferably about 0.7 times as large of opening diameter D2 of inlet opening 117.

Motion and working of thus constituted compressor is explained next. When rotor 107 of motor 108 rotates, piston 112 reciprocates in cylinder 114. In a suction process where piston 112 moves from the top dead center to the bottom dead center, pressure inside cylinder 114 is decreased, drawing cooling medium existing in muffling space 115 of suction muffler 116 into cylinder 114. Pressure inside muffling space 115 is thus decreased and draws in cooling medium that exists in hermetic container 104 through inlet opening 117. At that time, the cooling medium flows into hermetic container 104 from the external refrigerating system (not illustrated) through suction pipe 101.

In a following compressing process where piston 112 moves from the bottom dead center to the top dead center, piston 112 compresses cooling medium in cylinder 114. The compressed cooling medium is discharged to the external refrigerating system.

As described above, compressing mechanism 109 repeats suction process and discharge process as piston 112 makes the reciprocating movement. In these processes, the cooling medium inside muffling space 115 is intermittently drawn into cylinder 114, and the cooling medium in hermetic container 104 is intermittently drawn into the mechanism through inlet opening 117.

Volume in hermetic container 104 is significantly larger than effective cylinder volume V2 of compressing mechanism 109, thereby intermittent drawing action of cooling medium through inlet opening 117 is smoothed. Therewith, the cooling medium flows into hermetic container 104 almost continuously from the external refrigerating system through suction pipe 101.

The cooling medium returned from the external refrigerating system is usually in a temperature which is close to outside air temperature, namely the cooling medium arriving in large diameter part 102 of suction pipe 101 retains this low temperature level. On the other hand, temperature of the cooling medium in hermetic container 104 is raised far higher than the outside air temperature as the cooling medium is exposed to high temperature compressing mechanism 109 and motor 108.

In this exemplary embodiment, inlet opening 117 is disposed closely facing opening 105 of suction pipe 101, letting the low temperature cooling medium in large diameter part 102 drawn in intermittently through inlet opening 117. Namely, the low temperature cooling medium is supplied to cylinder 114. Consequently, a refrigerating capacity of the compressor is increased therefore refrigerating efficiency of the compressor is enhanced.

If inlet opening 117 of suction muffler 116 and outer surface 118 are disposed forming an obtuse angle, or if an inner periphery of inlet opening 117 is largely chamfered in a shape of a bugle, the refrigerating capacity is not greatly increased. This is because the cooling medium heated to a high temperature at around inlet opening 117 is drawn in by a higher percentage.

In this exemplary embodiment, inlet opening 117 is slightly protruded from outer surface 118 of suction muffler 116. With this structure, inlet opening 117 can selectively draw in cooling medium that exists in large diameter part 102 toward which inlet opening 117 is extended. It is interpreted that this is because a suction path of less disturbed cooling medium gas is formed around the extended line of inlet opening 117. Alternately, having inlet opening 117 protruded, inlet opening 117 of suction muffler 116 and outer surface 118 of suction muffler 116 can be disposed forming an acute angle. With this arrangement, the refrigerating capacity of the compressor is also increased, enhancing refrigerating efficiency of the compressor. Even if the angle made by inlet opening 117 and outer surface 118 of suction muffler 116 are slightly dull, or even if inlet opening 117 has a curved finish or is chamfered, inlet opening 117 can selectively draw in the cooling medium existing in front of inlet opening 117.

In this exemplary embodiment, volume V1 in large diameter part 102 of suction pipe 101 is made about 0.5 times as large of effective cylinder volume V2 of compressing mechanism 109. Most of the low temperature cooling medium stored in large diameter part 102 is drawn in intermittently through inlet opening 117 and then inside of large diameter part 102 is momentarily replaced by high temperature cooling medium existing in hermetic container 104. However, by taking above-mentioned ratio in volumes, the cooling medium is almost continually flowed from the external refrigerating system to suction pipe 101, namely inside large diameter part 102 of suction pipe 101 is refilled with the cooling medium having a temperature close to outside air temperature. With this process repeated, the low temperature cooling medium is continually supplied to suction muffler 116, greatly increasing the refrigerating capacity, consequently making the refrigerating efficiency of the compressor significantly high.

Motor 108 and compressing mechanism 109 are flexibly-supported by spring 110. This arrangement may occasionally cause mismatching of the extended line of inlet opening 117 with opening 105, of suction pipe 101. However, in this exemplary embodiment, internal diameter D1 of opening 105 is made larger than opening diameter D2 of inlet opening 117. Namely, the opening area of opening 105 is larger than that of inlet opening 117. Thus, the extended line of inlet opening 117 does not greatly deviate from a scope of internal diameter D1 of opening 105, even when compressing mechanism 109 moves a little. Thereby, variation in efficiency of the compressor is kept small.

In this exemplary embodiment, length L1 of large diameter part 102 is made larger than internal diameter D1 of large diameter part 102. With this arrangement, the cooling medium stream flowed from small diameter part 103 to large diameter part 102 is stabilized. If the length of large diameter part 102 is short, the cooling medium stream flowed from small diameter part 103 to large diameter part 102 is disturbed due to a change of the diameters. The cooling medium arriving at opening 105 with its stream disturbed flows into hermetic container 104 diffusely. By making length L1 of large diameter part 102 long as in this exemplary embodiment, the cooling medium stream is stabilized. Accordingly, the cooling medium flowing into hermetic container 104 is steamed toward inlet opening 117 that closely faces large diameter part 102.

Suction pipe 101 is fixed with hermetic container 104 which is in high temperature, so the cooling medium becomes hot receiving heat from hermetic container 104. Naturally, the cooling medium stored in V1, inside volume of large diameter part 102, is heated easily in a vicinity of opening 105. If length L1 of large diameter part 102 gets longer, a percentage of the cooling medium that becomes hot in the staying cooling medium is reduced, consequently supplying low temperature cooling medium to suction muffler 116. With these effects, lower temperature cooling medium is supplied to cylinder 114, enhancing the refrigerating efficiency of the compressor.

Figure 3:
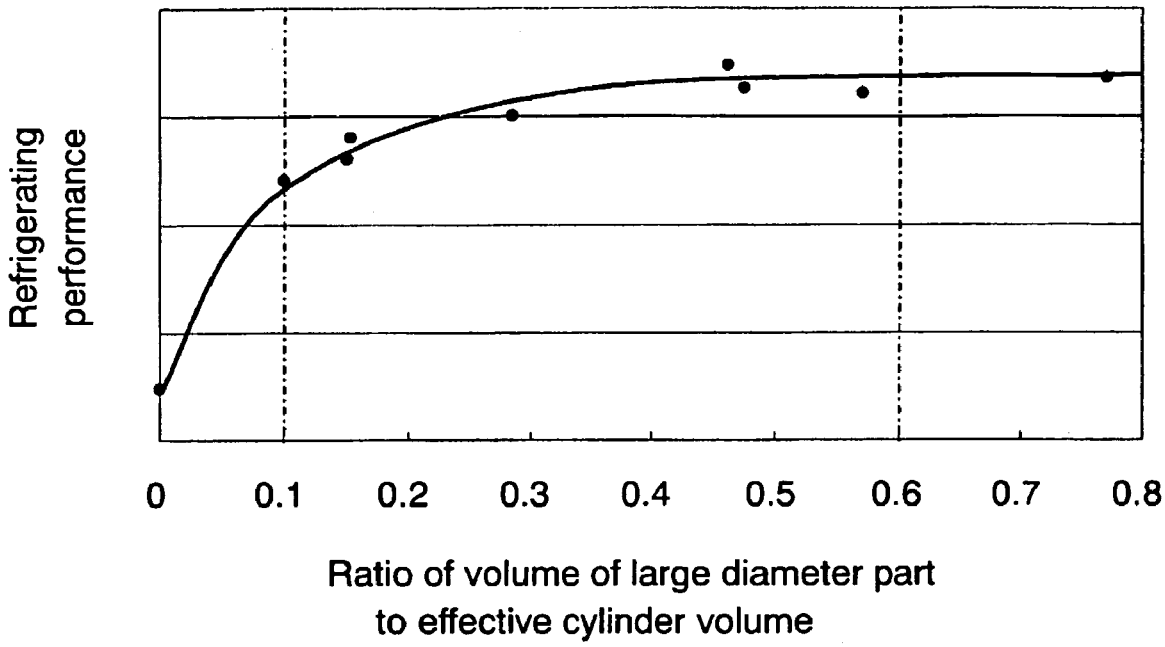
FIG. 3 is a graphical illustration showing a relation between a refrigerating performance and volume of a large diameter part of the hermetic compressor in accordance with the exemplary embodiment.
Figure 4:
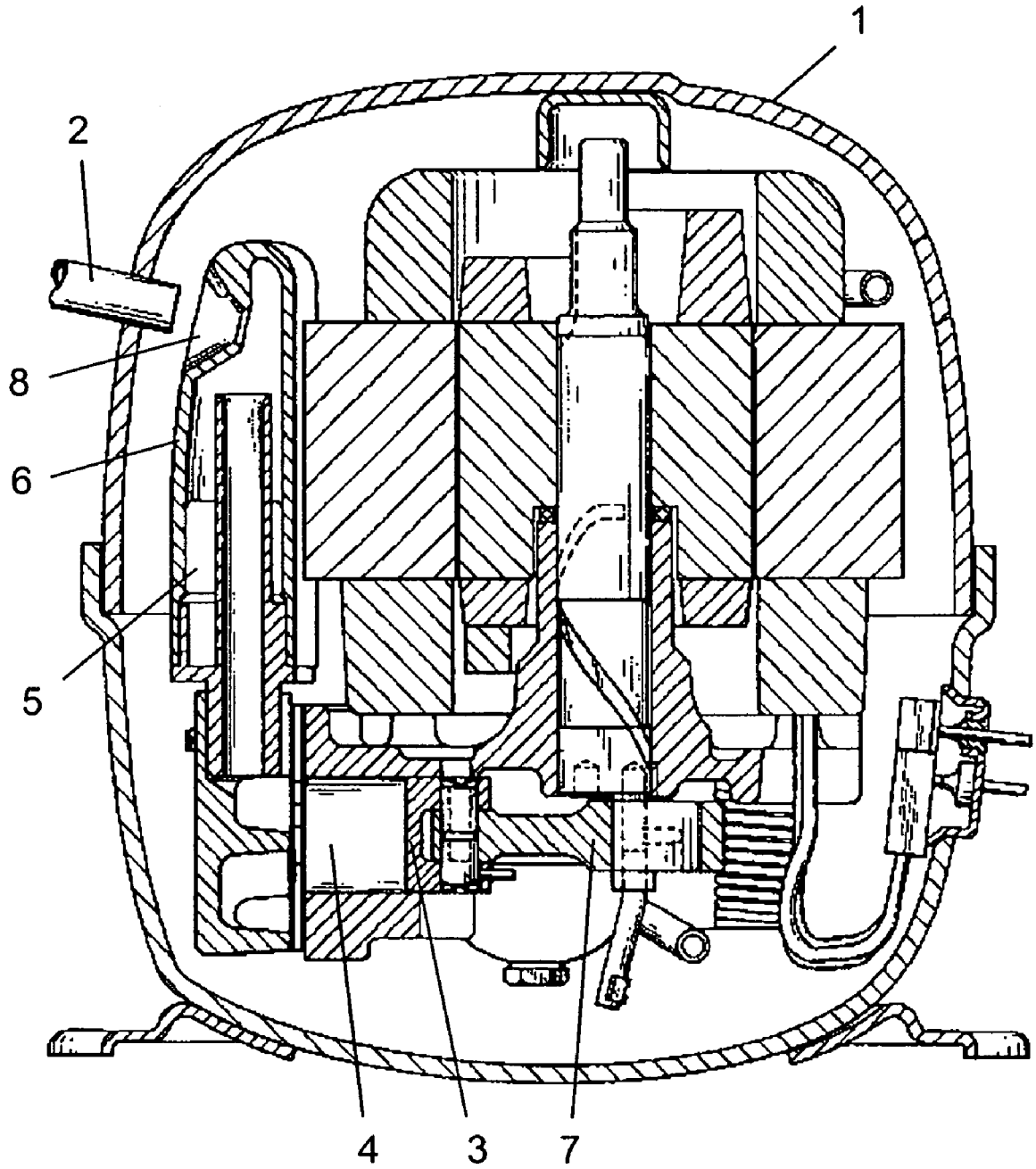
FIG. 4 PRIOR ART
FIG. 4 is a cross-sectional view of a conventional hermetic compressor.

Next, details of dimensional specification are described with their parameterized numbers. FIG. 3 shows the measured efficiency of the hermetic compressor using parametric ratio between volume V1 of large diameter part 102 and effective cylinder volume V2 of compressing mechanism 109. Apparently shown in FIG. 3, refrigerating performance is greatly increased when the ratio is 0.1 or larger. As the ratio increases, the efficiency is also increased. When volume V1 is too small compared to effective cylinder volume V2, an amount of low temperature cooling medium stored in large diameter part 102 is not enough for that drawn in through inlet opening 117 of suction muffler 116. So, a large amount of high temperature cooling medium existing in hermetic container 104 is drawn together in. Because of this phenomenon, it is considered that refrigerating performance is enhanced when the ratio is 0.1 or higher.

When the ratio of volume V1 to effective cylinder volume V2 exceeds 0.6, increase of refrigerating performance is saturated. It is considered because the cooling medium stored in volume V1 of large diameter part 102 reaches an amount sufficient enough for the amount drawn through inlet opening 117.

When volume V1 of large diameter part 102 is unnecessarily large, problems arise. For example, cost increases, size of the compressor becomes large, and installation of the compressor is restricted. To avoid such problems, the ratio of volume V1 formed in large diameter part 102 to effective cylinder volume V2 formed in compressing mechanism 109 is suitably defined to be at least 0.1 and at most 0.6.

Finally, preferable distance L2 between inlet opening 117 and opening 105 is explained. If inlet opening 117 is situated too far from opening 105, inlet opening 117 easily draws in high temperature cooling medium existing in hermetic container 104, reducing a refrigerating performance. If it is too closely situated, inlet opening 117 may touch hermetic container 104 or suction pipe 101 when compressing mechanism 109 is moved, for example, during transport. At that time suction muffler 116 may damaged. To avoid of such incident, a ratio of distance L2 between inlet opening 117 and opening 105 to opening diameter D2 of inlet opening 117 is preferably defined at least 0.3 and at most 1.0. With this arrangement, high reliability is obtained while maintaining high efficiency.

INDUSTRIAL APPLICABILITY

A hermetic compressor according to the present invention has high efficiency. Therefore, it can be applied to a refrigerator, an air-conditioner, a refrigerating freezer, and so on.

The invention claimed is:

1. A hermetic compressor comprising:

a hermetic container;

a suction pipe including:

a large diameter part having a first substantially constant diameter and an opening;

a small diameter part having a second substantially constant diameter and connected to an external refrigerating system; and a transition part connecting the large diameter part with the small diameter part, wherein the suction pipe is fixed with the hermetic container, and the opening of the large diameter part is located at an inside of the hermetic container;

a compressing mechanism being accommodated inside the hermetic container;

a suction muffler for forming a muffling space communicated with the compressing mechanism; and an inlet opening provided in the suction muffler, the inlet opening communicating the muffling space with an inside space of the hermetic container, the inlet opening spaced from the opening of the large diameter part of the suction pipe by a gap, the gap located at the inside of the hermetic container and communicating with the inside space of the hermetic container.

2. The hermetic compressor according to claim 1, wherein an opening area of the large diameter part is larger than an opening area of the inlet opening.

3. The hermetic compressor according to claim 1, wherein the inlet opening is protruded from an outer surface of the suction muffler.

4. The hermetic compressor according to claim 1, wherein a distance from the opening of the large diameter part to the small diameter part is larger than an internal diameter of the large diameter part.

5. The hermetic compressor according to claim 1, wherein the compressing mechanism includes a cylinder and a piston reciprocating inside the cylinder.

6. The hermetic compressor according to claim 5, wherein volume of the large diameter part is at least 0.1 times and at most 0.6 times of volume in the cylinder from a bottom dead center of the piston to a top dead center of the piston.

7. The hermetic compressor according to claim 1, wherein a distance between the inlet opening and the opening of the large diameter part is at least 0.3 times and at most 1.0 times of a diameter of the inlet opening.

8. The hermetic compressor according to claim 1, wherein the inlet opening is included in a pipe extending into an inside of the suction muffler and having another opening at the inside of the suction muffler.

* * * * *